US008764348B2

(12) United States Patent
Ruel

(10) Patent No.: US 8,764,348 B2
(45) Date of Patent: Jul. 1, 2014

(54) RETAINING WALL SYSTEMS AND METHODS

(76) Inventor: Steve Ruel, Scotts Valley, CA (US)

( * ) Notice: Subject to any disclaimer, the term of this patent is extended or adjusted under 35 U.S.C. 154(b) by 169 days.

(21) Appl. No.: 13/233,926

(22) Filed: Sep. 15, 2011

(65) Prior Publication Data

US 2012/0063852 A1 Mar. 15, 2012

Related U.S. Application Data

(60) Provisional application No. 61/383,199, filed on Sep. 15, 2010.

(51) Int. Cl.
*E02D 29/02* (2006.01)

(52) U.S. Cl.
USPC ..... 405/284; 405/262; 405/286

(58) Field of Classification Search
USPC ..... 405/262, 284, 286, 302.4, 302.6, 302.7; 403/206, 209, 207
See application file for complete search history.

(56) References Cited

U.S. PATENT DOCUMENTS

| | | | | |
|---|---|---|---|---|
| 3,747,353 | A | 7/1973 | Monahan | |
| 4,343,571 | A | 8/1982 | Price | |
| 4,470,728 | A | 9/1984 | Broadbent | |
| 4,494,892 | A | 1/1985 | Wojciechowski | |
| 4,756,645 | A | 7/1988 | Balzer | |
| 4,929,125 | A | 5/1990 | Hilfiker | |
| 4,960,349 | A | 10/1990 | Willibey | |
| 5,259,704 | A * | 11/1993 | Orgorchock | 405/262 |
| 5,533,839 | A | 7/1996 | Shimada | |
| 5,549,418 | A | 8/1996 | Devine | |
| 6,086,288 | A | 7/2000 | Ruel et al. | |
| 6,238,144 | B1 | 5/2001 | Babcock | |
| 6,685,400 | B1 | 2/2004 | Ruel et al. | |
| 6,793,436 | B1 | 9/2004 | Ruel et al. | |
| 6,860,681 | B2 | 3/2005 | Ruel | |
| 6,908,263 | B1 | 6/2005 | Ruel et al. | |
| 6,939,087 | B2 | 9/2005 | Ruel | |
| 7,125,202 | B2 | 10/2006 | Morizot et al. | |
| 7,503,719 | B1 | 3/2009 | Ruel et al. | |
| 7,857,540 | B2 | 12/2010 | Ruel et al. | |
| 2003/0185634 | A1 | 10/2003 | Babcock | |
| 2006/0239783 | A1 * | 10/2006 | Kallen | 405/284 |
| 2011/0103897 | A1 | 5/2011 | Ruel | |

FOREIGN PATENT DOCUMENTS

| | | |
|---|---|---|
| JP | 02128017 | 5/1990 |
| JP | 03051426 | 8/1998 |

* cited by examiner

*Primary Examiner* — Sean Andrish
(74) *Attorney, Agent, or Firm* — Michael R. Schacht; Schacht Law Office, Inc.

(57) ABSTRACT

A retaining wall system employs a wall structure, at least one grid member, and first and second rods. The wall structure comprises a wall member and a plurality of wall loops. The first and second rods extend between at least two of the plurality of wall loops. At least portions of at least one of the first and second rods may pass through the wall loops. A grid member is arranged at least partly around one of the first and second rods such that tension applied to one grid member causes one grid member to engage the first and second rods to increase friction between the at least one grid member and the first and second rods. One of the first and second rods is inserted at least partly through one of the wall loops to transfer tension loads on one grid member to the wall member.

25 Claims, 4 Drawing Sheets

RETAINING WALL SYSTEMS AND METHODS

RELATED APPLICATIONS

This application, U.S. patent application Ser. No. 13/233,926, claims benefit of priority to U.S. Provisional Patent Application Ser. No. 61/383,199, filed Sep. 15, 2010, the contents of which are incorporated herein by reference.

TECHNICAL FIELD

The present invention relates to retaining wall systems and methods and, more particularly, to systems and methods for connecting a retaining wall to a grid member buried in backfill.

BACKGROUND

Wall systems are commonly used in construction projects. In particular, construction projects such as home building and road construction often require that the ground be excavated to obtain a flat and/or substantially level surface. The process of leveling the ground may require the formation of a vertical face adjacent to the leveled surface. To maintain the vertical face, wall systems are used. Often, it is desirable to tie the wall system often in to the earth or ground behind the wall system for additional stability.

The need thus exists for improved systems and methods for stabilizing retaining wall systems.

SUMMARY

The present invention may be embodied as a retaining wall system comprising a wall structure, at least one grid member, and first and second rods. The wall structure comprises a wall member and a plurality of wall loops. The first and second rods are sized and dimensioned to extend between at least two of the plurality of wall loops and such that at least portions of at least one the first and second rods may pass through the wall loops. The at least one grid member is arranged at least partly around at least one of the first and second rods such that tension applied to the at least one grid member causes the at least one grid member to engage the first and second rods to increase friction between the at least one grid member and the first and second rods. At least one of the first and second rods is inserted at least partly through at least one of the wall loops to transfer tension loads on the at least one grid member to the wall member.

The present invention may also be embodied as a method of forming a retaining wall system comprising the following steps. A wall structure comprising a wall member and a plurality of wall loops is provided. At least one grid member is provided. First and second rods are provided. The first and second rods are sized and dimensioned to extend between at least two of the plurality of wall loops and such that at least portions of at least one of the first and second rods may pass through the wall loops. The at least one grid member is arranged at least partly around at least one of the first and second rods. At least one of the first and second rods is inserted at least partly through at least one of the wall loops. Backfill is arranged on the at least one grid member to apply tension to the at least one grid member to cause the at least one grid member to engage the first and second rods to increase friction between the at least one grid member and the first and second rods, thereby facilitating the transfer of tension loads on the at least one grid member to the wall member.

DETAILED DESCRIPTION

Figure 1:
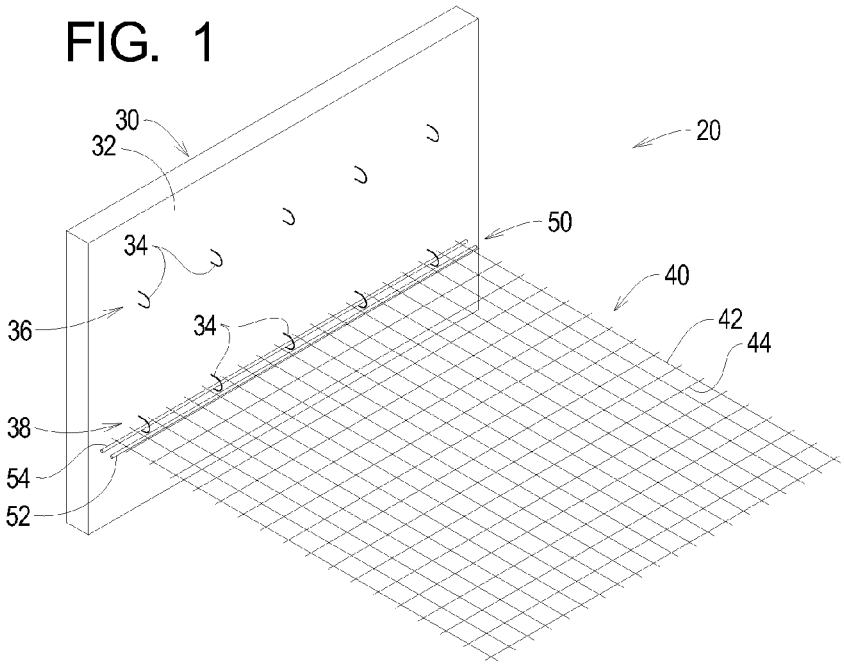
FIG. 1 is a perspective view of a first example retaining wall system of the present invention.
Figure 2:
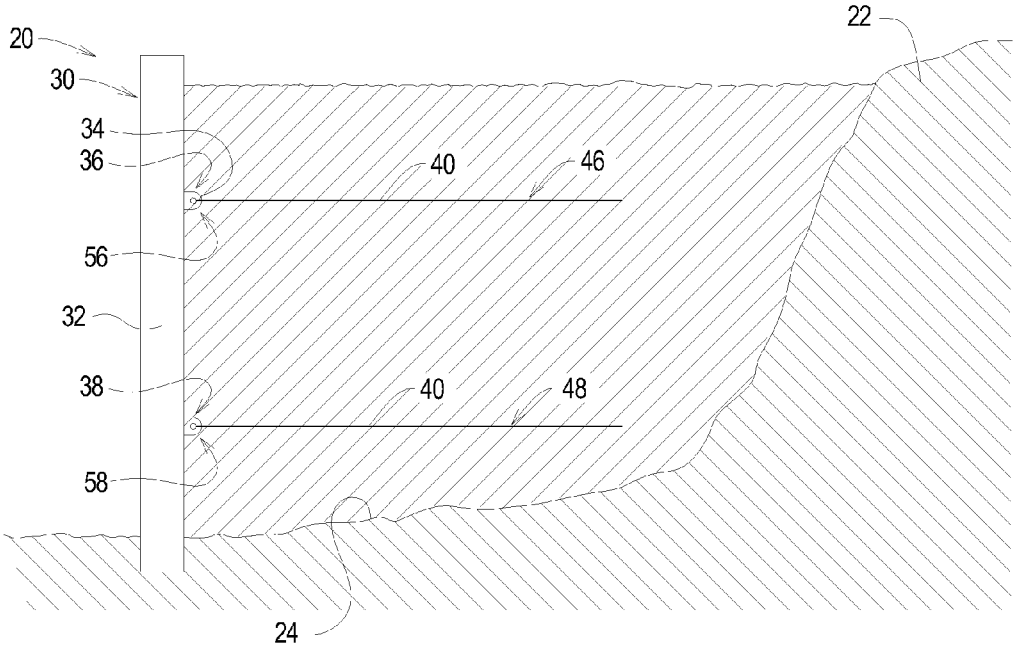
FIG. 2 is a side elevation view depicting a configuration of the first example retaining wall system of the present invention in situ.

Referring initially to FIGS. 1 and 2 of the drawing, depicted therein is a first example retaining wall system 20 constructed in accordance with, and embodying, the principles of the present invention. As shown in FIG. 2, the first example retaining wall system 20 may be supported by an example earth structure 22. The example earth structure 22 defines a surface 24 having a surface profile. Backfill material 26 is arranged on the surface 24.

The example retaining wall system 20 comprises a wall structure 30 comprising a wall member 32 and at least one wall loop 34. The example wall structure 30 comprises a plurality (two or more) of the wall loops 34 arranged in first and second rows 36 and 38.

The example wall system 20 further comprises at least one example grid member 40 comprising a plurality (two or more) of longitudinal members 42 and lateral members 44. The example wall system 20 comprises first and second courses 46 and 48 of the grid members 40.

The example wall system 20 further comprises at least one rod pair 50 comprising a first rod 52 and a second rod 54. The example rod pairs 50 are arranged in a first set 56 and a second set 58.

Referring now to FIGS. 3-7, it can be seen that the example wall member 32 defines a rear face 60. FIGS. 3-7 also show that the example wall loops 34 comprise first and second anchor portions 62 and 64 and an exposed portion 66. The anchor portions 62 and 64 are embedded within the wall member 32 to inhibit relative movement between the wall loops 34 and the wall member 32. The rear face 60 and the exposed portions 66 define a loop opening 68. In the example system 20, the loop openings 68 of each course of wall loops are aligned to define first and second loop passageways 70 and 72 associated with the first row 36 and the second row 38 of wall loops 34.

FIGS. 3-7 further illustrate a number of grid profiles in which rods 52 and 54 interact with the wall loop 34 and the grid member 40 interacts with the rods 52 and 54 in a tortuous path that creates friction between the grid member 40 and the rods 52 and 54, thereby inhibiting relative movement between the wall member 32 and the grid member 40. In FIGS. 3-7, for clarity spaces are shown between the wall loop 34, the grid member 40, the rods 52 and 54, and the rear face 60 of the wall member 32. During installation and use of the retaining wall system 20, however, tension applied to the grid member 40 pulls the wall loop 34, the grid member 40, the rods 52 and 54 together to eliminate these spaces to cause the friction discussed above.

Figure 3:
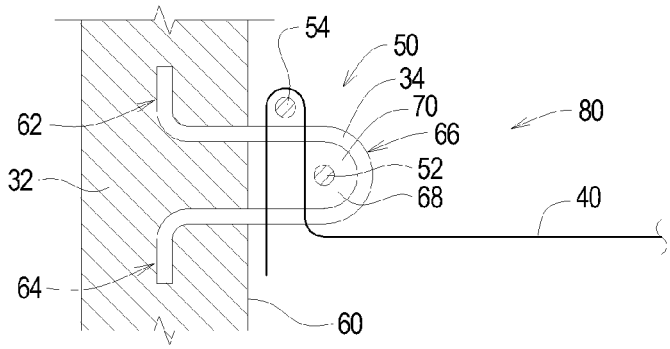
FIG. 3 is a side elevation view of a first example grid profile that may be used by the first example retaining wall system.

FIG. 3 illustrates a first example grid profile 80 in which the first rod 52 extends through the loop passageway 70 and the second rod 54 extends above the loop passageway 70 on top of the exposed portion 66 of the wall loops 34. In the first example grid profile 80, the example grid member 40, and in particular end portions of the longitudinal members 42 of the grid member 40, are extended under the first rod 52, over the second rod 54, and down along the rear face 60 of the wall member 32. The rods 52 and 54 engage the wall loop 34 such that, when the grid member 40 is placed under tension, friction between the grid member 40 and the rods 52 and 54 inhibits relative movement between the wall member 32 and the grid member 40.

Figure 4:
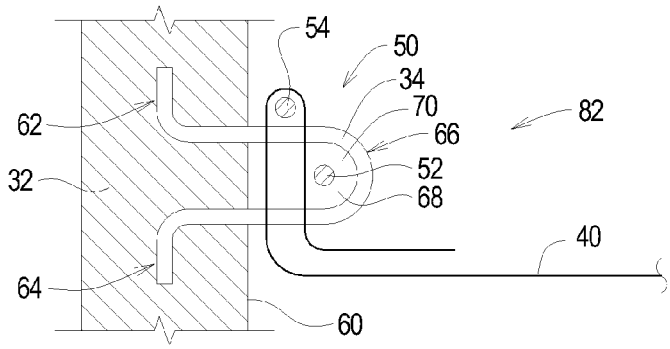
FIG. 4 is a side elevation view of a second example grid profile that may be used by the first example retaining wall system.

FIG. 4 illustrates a second example grid profile 82 in which the first rod 52 extends through the loop passageway 70 and the second rod 54 extends above the loop passageway 70 on top of the exposed portion 66 of the wall loops 34. In the second example grid profile 82, the example grid member 40, and in particular end portions of the longitudinal members 42 of the grid member 40, are extended under the first rod 52 and the second rod 54, over the second rod 54, down between the first and second rods 52 and 54, under the first rod 52, and back substantially parallel to and above a buried portion of the grid member 40. The rods 52 and 54 engage the wall loop 34 such that, when the grid member 40 is placed under tension, friction between the grid member 40 and the rods 52 and 54 inhibits relative movement between the wall member 32 and the grid member 40.

Figure 5:
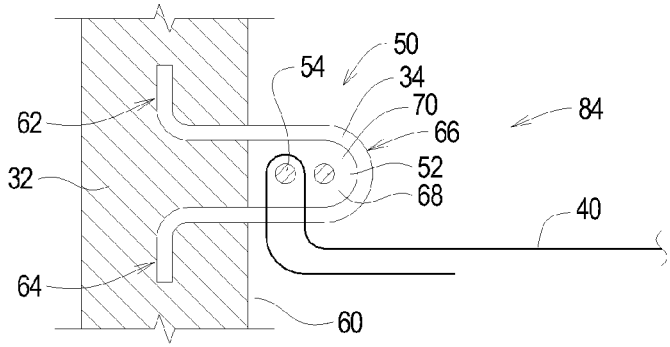
FIG. 5 is a side elevation view of a third example grid profile that may be used by the first example retaining wall system.

FIG. 5 illustrates a third example grid profile 84 in which the first rod 52 and the second rod 54 extend through the loop passageway 70. In the third example grid profile 84, the example grid member 40, and in particular end portions of the longitudinal members 42 of the grid member 40, are extended under the first rod 52, over the second rod 54, down along the rear face 60 of the wall member 32, and back substantially parallel to and under the buried portion of the grid member 40. The rods 52 and 54 engage the wall loop 34 such that, when the grid member 40 is placed under tension, friction between the grid member 40 and the rods 52 and 54 inhibits relative movement between the wall member 32 and the grid member 40. In this third example grid profile 84, placing the grid member 40 in tension will further pull the first and second rods 52 and 54 together, effectively clamping the grid member 40 therebetween.

Figure 6:
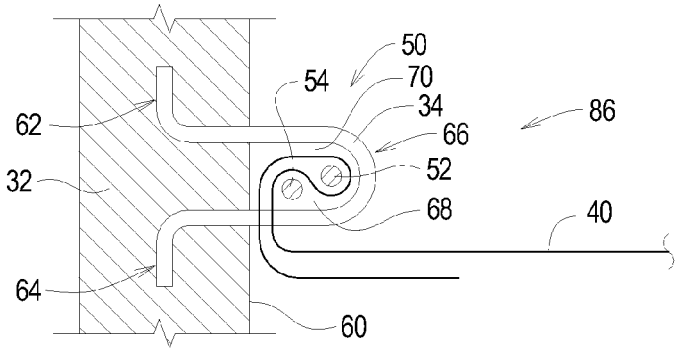
FIG. 6 is a side elevation view of a fourth example grid profile that may be used by the first example retaining wall system.

FIG. 6 illustrates a fourth example grid profile 88 in which the first rod 52 and the second rod 54 extend through the loop passageway 70. In the fifth example grid profile 88, the example grid member 40, and in particular end portions of the longitudinal members 42 of the grid member 40, are extended under the first rod 52 and the second rod 54, over the second rod 54, between the first and second rods 52 and 54, over the first and second rods 52 and 54, down along the rear face 60 of the wall member 32, and back substantially parallel to and under the buried portion of the grid member 40. The rods 52 and 54 engage the wall loop 34 such that, when the grid member 40 is placed under tension, friction between the grid member 40 and the rods 52 and 54 inhibits relative movement between the wall member 32 and the grid member 40. In this fourth example grid profile 86, placing the grid member 40 in tension will further pull the first and second rods 52 and 54 together, effectively clamping the grid member 40 therebetween.

Figure 7:
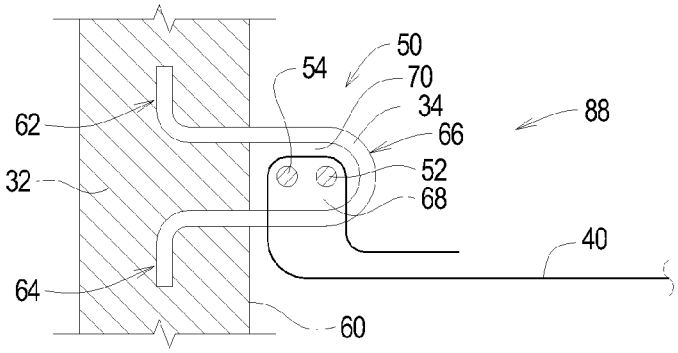
FIG. 7 is a side elevation view of a fifth example grid profile that may be used by the first example retaining wall system.

FIG. 7 illustrates a fifth example grid profile 86 in which the first rod 52 and the second rod 54 extend through the loop passageway 70. In the fourth example grid profile 86, the example grid member 40, and in particular end portions of the longitudinal members 42 of the grid member 40, are extended under the first rod 52 and the second rod 54, over the first rod 52 and the second rod 54, down in front of the first rod 52, and back substantially parallel to and above the buried portion of the grid member 40. The rods 52 and 54 engage the wall loop 34 such that, when the grid member 40 is placed under tension, friction between the grid member 40 and the rods 52 and 54 inhibits relative movement between the wall member 32 and the grid member 40.

Figure 8:
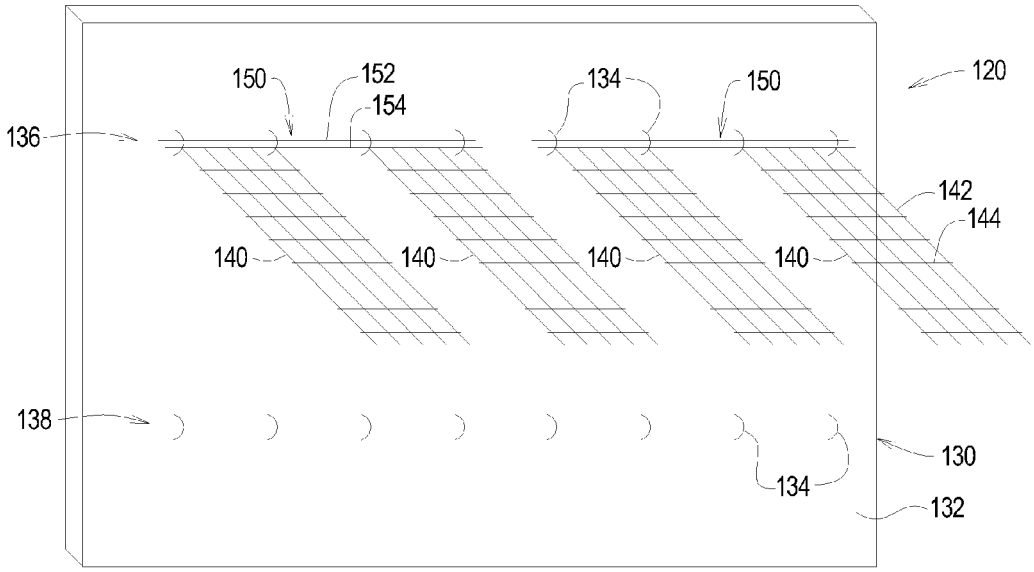
FIG. 8 is a perspective view of a second example retaining wall system of the present invention.

Referring now to FIG. 8 of the drawing, depicted therein is a second example retaining wall system 120 constructed in accordance with, and embodying, the principles of the present invention. The second example retaining wall system 120 may be supported by an earth structure such as the example earth structure 22 depicted in FIG. 2. Again, backfill material is arranged on a surface of the earth structure.

The example retaining wall system 120 comprises a wall structure 130 comprising a wall member 132 and at least one wall loop 134. The example wall structure 130 comprises a plurality (two or more) of the wall loops 134 arranged in first and second rows 136 and 138.

The example wall system 120 further comprises a plurality (two or more) of example grid members 140 each comprising a plurality (two or more) of longitudinal members 142 and lateral members 144. The example grid members 140 are mesh sheets of material suitable for being buried within backfill material and for bearing the tension loads necessary reinforce the wall structure 130. The grid members 140 may be rigid but will typically be flexible. If rigid, the grid members 140 may be pre-formed in a shape that allows formation of the grid profiles as will be described in further detail herein. The example wall system 120 comprises first and second courses each comprising a plurality (two or more) of the grid members 140, although only the first course 142 is depicted in FIG. 8 for purposes of clarity. The first course is associated with the first row 136 of wall loops 134, and the second course is associated with the second row 138 of wall loops 134.

The example wall system 120 further comprises at least one rod pair 150 comprising a first rod 152 and a second rod 154. The example rod pairs 150 are arranged in a first set 156 and a second set 158. FIG. 8 illustrates that the example wall system 120 comprises a plurality (two or more) of rod pairs 150 for each of the courses 146 and 148. The example rod pairs 150 each extend through a plurality (two or more) of the grid members 140 in one of the courses of grid members 140.

Although FIG. 8 illustrates that each of the rod pairs 150 connects two adjacent grid members 140 to the wall member 130 using two of the wall loops 134, each rod pair 150 may extend through fewer than two (i.e., one) or more than two (i.e., three or more) of the grid members 140 depending on such factors as the width of the grid members 140, the spacing between the grid members 140, the spacing between the wall loops 134, and the length of the rods 152 and 154 forming the rod pairs 150.

In any event, the rod pairs 150 may be used to connect the grid members 140 to the wall member 130 using any of the grid profiles described above with respect to and/or depicted in FIGS. 3-7.

Figure 9:
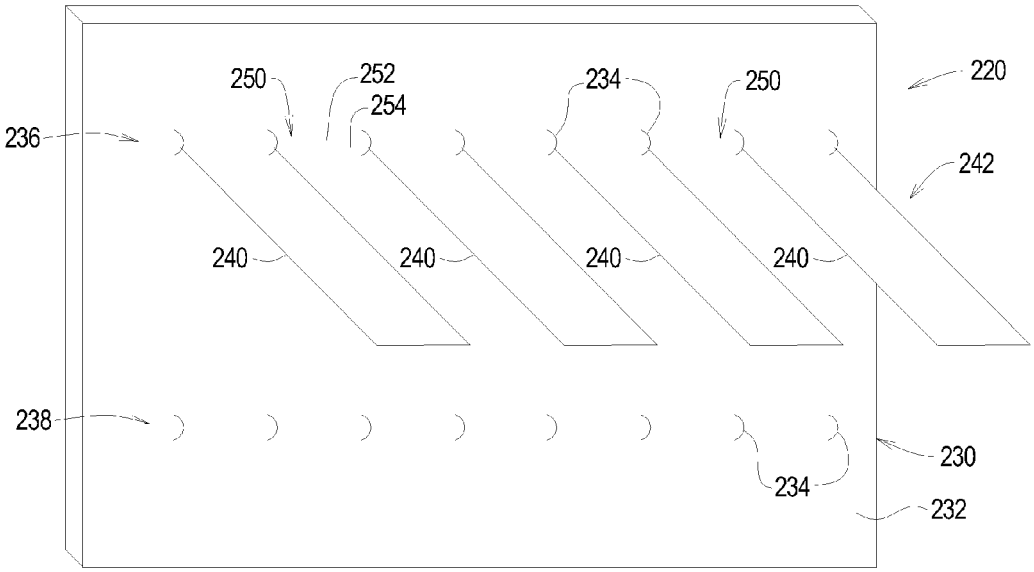
FIG. 9 is a perspective view of a third example retaining wall system of the present invention.

Referring now to FIG. 9 of the drawing, depicted therein is a third example retaining wall system 220 constructed in accordance with, and embodying, the principles of the present invention. The third example retaining wall system 220 may be supported by an earth structure such as the example earth structure 22 depicted in FIG. 2. Again, backfill material is arranged on a surface of the earth structure.

The example retaining wall system 220 comprises a wall structure 230 comprising a wall member 232 and at least one wall loop 234. The example wall structure 230 comprises a plurality (two or more) of the wall loops 234 arranged in first and second rows 236 and 238.

The example wall system 220 further comprises a plurality (two or more) of example grid members 240. The example grid members 240 are solid sheets of material suitable for being buried within backfill material and for bearing the tension loads necessary to reinforce the wall structure 230. The grid members 240 may be rigid but will typically be flexible. If rigid, the grid members 240 may be pre-formed in a shape that allows formation of the grid profiles as will be described in further detail herein. If flexible, strips of geotextile fabrics or the like may be suitable for use as the example grid members 240. The example wall system 220 comprises first and second courses each comprising a plurality (two or more) of the grid members 240, although only the first course 242 is depicted in FIG. 9 for purposes of clarity. The first course is associated with the first row 236 of wall loops 234, and the second course is associated with the second row 238 of wall loops 234.

The example wall system 220 further comprises at least one rod pair 250 comprising a first rod 252 and a second rod 254. The example rod pairs 250 are arranged in a first set 256 and a second set 258. The example wall system 220 comprises a plurality (two or more) of rod pairs 250 for each of the courses of grid members 240. The example rod pairs 250 each extend through a plurality (two or more) of the grid members 240 in one of the courses 242 and 244.

Although FIG. 9 illustrates that each of the rod pairs 250 connects two adjacent grid members 240 to the wall member 230 using two of the wall loops 234, each rod pair 250 may extend through fewer than two (i.e., one) or more than two (i.e., three or more) of the grid members 240 depending on such factors as the width of the grid members 240, the spacing between the grid members 240, the spacing between the wall loops 234, and the length of the rods 252 and 254 forming the rod pairs 250.

In any event, the rod pairs 250 may be used to connect the grid members 240 to the wall member 230 using any of the grid profiles described above with respect to and/or depicted in FIGS. 3-7.

From the foregoing, it should be apparent that the present invention may be embodied in many different combinations and sub-combinations of the elements and steps described above. The scope of the present invention should thus be determined by the claims to be appended hereto and not the foregoing detailed description.

What is claimed is:

1. A retaining wall system comprising:

a wall structure comprising a wall member and a plurality of wall loops;

at least one grid member; and first and second rods sized and dimensioned to extend between at least two of the plurality of wall loops and such that at least portions of at least one of the first and second rods passes through the wall loops; wherein the at least one grid member is arranged at least partly around at least one of the first and second rods such that tension applied to the at least one grid member causes the at least one grid member to engage the first and second rods to increase friction between the at least one grid member and the first and second rods; and the first and second rods are both inserted through one of the wall loops to transfer tension loads on the at least one grid member to the wall member; wherein the at least one grid member is arranged between the first and second rods such that one of the first and second rods is immediately adjacent to a lower surface of the at least one grid member and another of the first and second rods is immediately adjacent to an upper surface of the at least one grid member.

2. The retaining wall system as recited in claim 1, further comprising backfill material arranged on the at least one grid member.

3. The retaining wall system as recited in claim 1, in which:

the plurality of wall loops are arranged in a plurality of rows; and at least one grid member is provided for each of the plurality of rows of wall loops.

4. The retaining wall system as recited in claim 1, in which:

the plurality of wall loops are arranged in at least one row; and a plurality of grid members is provided for each row of wall loops.

5. The retaining wall system as recited in claim 1, in which:

the plurality of wall loops are arranged in a plurality of rows; and a plurality of grid members is provided for each row of wall loops.

6. The retaining wall system as recited in claim 1, in which the at least one grid member is arranged under the first rod and over the second rod.

7. The retaining wall system as recited in claim 6, in which the first rod extends at least partly through two of the wall loops.

8. The retaining wall system as recited in claim 1, in which the at least one grid member is arranged under the first and second rods, over the second rod, and under the first rod.

9. The retaining wall system as recited in claim 8, in which the first rod extends at least partly through two of the wall loops.

10. The retaining wall system as recited in claim 1, in which the at least one grid member is arranged under the first rod, over the second rod, and then under the first and second rods.

11. The retaining wall system as recited in claim 10, in which the first and second rods extend at least partly through two of the wall loops.

12. The retaining wall system as recited in claim 1, in which the at least one grid member is arranged under the first and second rods, between the first and second rods, and over the first and second rods.

13. The retaining wall system as recited in claim 12, in which the first and second rods extend at least partly through two of the wall loops.

14. The retaining wall system as recited in claim 1, in which the at least one grid member is arranged under each of the first and second rods and over each of the first and second rods.

15. The retaining wall system as recited in claim 14, in which the first and second rods extend at least partly through two of the wall loops.

16. A method of forming a retaining wall system comprising the steps of:

providing a wall structure comprising a wall member and a plurality of wall loops;

providing at least one grid member;

providing first and second rods sized and dimensioned to extend between at least two of the plurality of wall loops and such that at least portions of at least one of the first and second rods passes through the wall loops;

arranging the at least one grid member at least partly under the first rod and at least partly over the second rod such that tension applied to the at least one grid member causes the at least one grid member to engage the first and second rods to increase friction between the at least one grid member and the first and second rods;

inserting at least one of the first and second rods at least partly through at least one of the wall loops;

arranging backfill on the at least one grid member to apply tension to the at least one grid member to place the at least one grid member under tension, thereby facilitating the transfer of tension loads on the at least one grid member to the wall member; and arranging the at least one grid member between the first and second rods such that one of the first and second rods is immediately adjacent to a lower surface of the at least one grid member and another of the first and second rods is immediately adjacent to an upper surface of the at least one grid member.

17. The method as recited in claim 16, further comprising the step of extending the first rod at least partly through two of the wall loops.

18. The method as recited in claim 16, further comprising the step of extending the first and second rods at least partly through two of the wall loops.

19. A retaining wall system comprising:

a wall structure comprising a wall member and a plurality of wall loops;

at least one grid member; and first and second rods sized and dimensioned to extend between at least two of the plurality of wall loops and such that at least portions of at least one of the first and second rods passes through the wall loops; wherein the at least one grid member is arranged at least partly around at least one of the first and second rods such that tension applied to the at least one grid member causes the at least one grid member to engage the first and second rods to increase friction between the at least one grid member and the first and second rods; and the first and second rods are both inserted through one of the wall loops to transfer tension loads on the at least one grid member to the wall member; wherein the at least one grid member is arranged under the first and second rods, between the first and second rods, and over the first and second rods such that one of the first and second rods is immediately adjacent to a lower surface of the at least one grid member and another of the first and second rods is immediately adjacent to an upper surface of the at least one grid member.

20. The retaining wall system as recited in claim 19, further comprising backfill material arranged on the at least one grid member.

21. The retaining wall system as recited in claim 19, in which:

the plurality of wall loops are arranged in a plurality of rows; and at least one grid member is provided for each of the plurality of rows of wall loops.

22. The retaining wall system as recited in claim 19, in which:

the plurality of wall loops are arranged in at least one row; and a plurality of grid members is provided for each row of wall loops.

23. The retaining wall system as recited in claim 19, in which:

the plurality of wall loops are arranged in a plurality of rows; and a plurality of grid members is provided for each row of wall loops.

24. The retaining wall system as recited in claim 19, in which the first rod extends at least partly through two of the wall loops.

25. The retaining wall system as recited in claim 19, in which the first and second rods extend at least partly through two of the wall loops.

* * * * *